US012631168B2

(12) United States Patent
Takahashi

(10) Patent No.: US 12,631,168 B2
(45) Date of Patent: May 19, 2026

(54) CRYOPUMP AND CRYOPUMP REGENERATION METHOD

(71) Applicant: SUMITOMO HEAVY INDUSTRIES, LTD., Tokyo (JP)

(72) Inventor: Kakeru Takahashi, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 185 days.

(21) Appl. No.: 18/516,435

(22) Filed: Nov. 21, 2023

(65) Prior Publication Data

US 2024/0200544 A1 Jun. 20, 2024

(30) Foreign Application Priority Data

Dec. 14, 2022 (JP) ..... 2022-199650

(51) Int. Cl.
*F04B 37/08* (2006.01)
*F04B 49/22* (2006.01)

(52) U.S. Cl.
CPC ..... *F04B 37/085* (2013.01); *F04B 37/08* (2013.01); *F04B 49/22* (2013.01)

(58) Field of Classification Search
CPC ..... F04B 37/08; F04B 37/085
USPC ..... 62/55.5
See application file for complete search history.

(56) References Cited

U.S. PATENT DOCUMENTS

| | | | | |
|---|---|---|---|---|
| 5,375,424 | A | 12/1994 | Bartlett et al. | |
| 5,819,545 | A | 10/1998 | Eacobacci, Jr. et al. | |
| 5,862,671 | A * | 1/1999 | Lessard | F04B 37/085 62/55.5 |
| 7,415,831 | B2 | 8/2008 | Amundsen et al. | |
| 2004/0261425 | A1* | 12/2004 | Amundsen | F04B 37/08 62/55.5 |
| 2007/0125112 | A1* | 6/2007 | Tsuyuki | F04B 37/08 62/272 |
| 2015/0267693 | A1* | 9/2015 | Oikawa | F04B 37/085 62/55.5 |
| 2021/0054834 | A1 | 2/2021 | Mochidzuki | |

FOREIGN PATENT DOCUMENTS

| | | | | |
|---|---|---|---|---|
| JP | H08-507115 | A | 7/1996 | |
| JP | H09280174 | A * | 10/1997 | F04B 37/08 |
| JP | 2001-515176 | A | 9/2001 | |
| JP | 2007-521438 | A | 8/2007 | |
| TW | 201945641 | A | 12/2019 | |
| WO | 94/19608 | A1 | 9/1994 | |
| WO | 2019/208336 | A1 | 10/2019 | |

* cited by examiner

*Primary Examiner* — John F Pettitt, III
(74) *Attorney, Agent, or Firm* — Michael Best & Friedrich LLP

(57) ABSTRACT

A cryopump regeneration method includes: supplying diluent gas to a cryopump in the middle of a cooling operation; accumulating the diluent gas on a cryogenic surface in the cryopump; revaporizing another gas trapped on the cryogenic surface together with the diluent gas; and exhausting mixed gas of the revaporized gas and the diluent gas from the cryopump. The diluent gas may be purge gas.

8 Claims, 4 Drawing Sheets

CRYOPUMP AND CRYOPUMP REGENERATION METHOD

CROSS-REFERENCE TO RELATED APPLICATIONS

This application claims priority to Japanese Patent Application No. 2022-199650, filed on Dec. 14, 2022, which is incorporated by reference herein in its entirety.

BACKGROUND

Technical Field

Certain embodiments of the present invention relate to a cryopump and a cryopump regeneration method.

Description of Related Art

A cryopump is a vacuum pump that traps gas molecules through condensation and/or adsorption on a cryopanel cooled to a cryogenic temperature and exhausts the gas molecules. The cryopump is generally used in order to realize a clean vacuum environment required for a semiconductor circuit manufacturing process or the like. Since the cryopump is a so-called gas accumulating type vacuum pump, regeneration in which the trapped gas is periodically exhausted to the outside is required.

SUMMARY

According to one embodiment of the present invention, there is provided a cryopump including: a cryopump container; a cryopanel disposed in the cryopump container; a cryocooler provided in the cryopump container and thermally coupled to the cryopanel; a body purge valve configured to supply purge gas to the cryopump container; and a regeneration controller configured to control the body purge valve such that purge gas is supplied to the cryopump container in the middle of a cooling operation of the cryocooler where the cryopanel is cooled.

According to another embodiment of the present invention, there is provided a cryopump regeneration method including: supplying diluent gas to a cryopump in the middle of a cooling operation of a cryocooler of the cryopump; accumulating the diluent gas on a cryogenic surface in the cryopump; revaporizing another gas trapped on the cryogenic surface together with the diluent gas; and exhausting mixed gas of the revaporized gas and the diluent gas from the cryopump.

DETAILED DESCRIPTION

Figure 1:
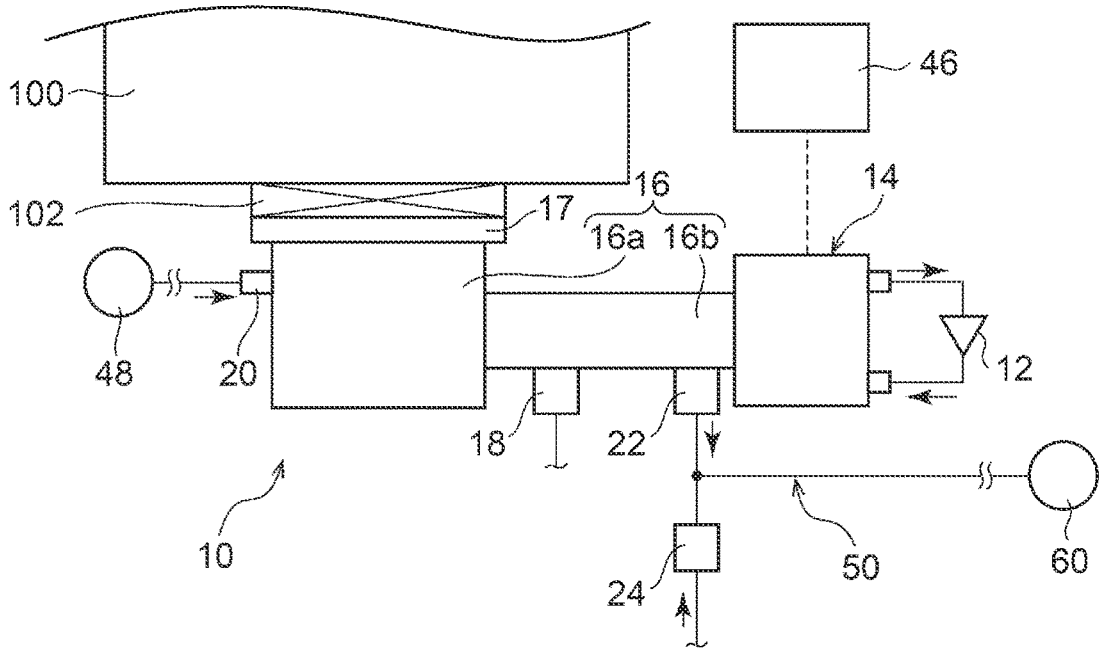
FIG. 1 is a diagram schematically illustrating a cryopump system according to an embodiment.

In a semiconductor manufacturing process, hazardous gas having various hazardous properties such as explosiveness, corrosiveness, and toxicity may be used. The hazardous gas accumulated in the cryopump is exhausted from the cryopump by regeneration. Immediately after regeneration start, the accumulated hazardous gas is rapidly revaporized due to an increase in the temperature of the cryopump, and the concentration of the hazardous gas in the cryopump may significantly increase.

It is desirable to suppress the concentration of hazardous gas exhausted from a cryopump during regeneration of the cryopump.

Any combinations of the above components or replacements of components or expressions of the present invention between methods, devices, systems, or the like are also effective as aspects of the present invention.

Hereinafter, embodiments for carrying out the present invention will be described in detail with reference to the accompanying drawings. In the description and drawings, the same or equivalent components, members, and processes are denoted by the same reference numerals, and overlapping descriptions are omitted as appropriate. The scales and shapes of the illustrated parts are set for convenience in order to facilitate explanation, and should not be construed in a limited manner unless otherwise specified. The embodiment is an example and does not limit the scope of the present invention. All features and combinations thereof described in the embodiment are not necessarily essential to the invention.

Figure 2:
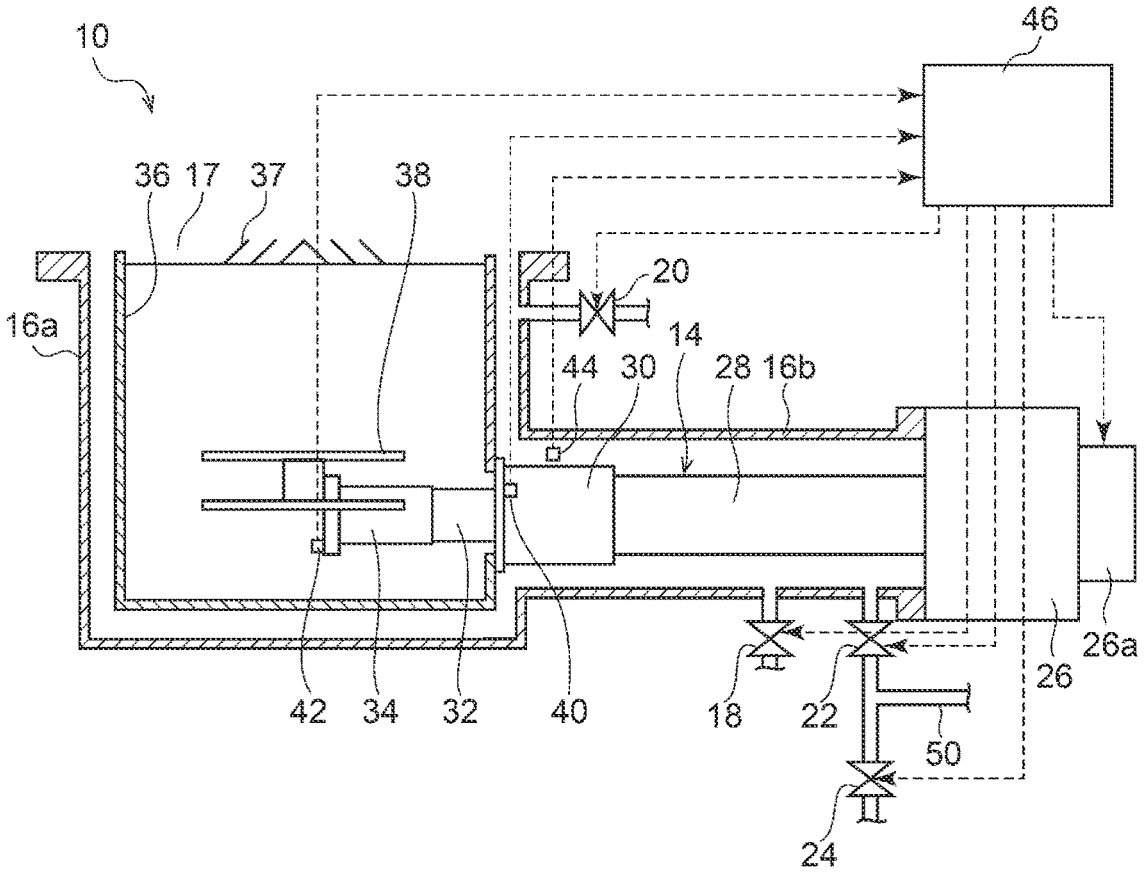
FIG. 2 is a diagram schematically illustrating the cryopump system according to the embodiment.

FIGS. 1 and 2 schematically show a cryopump system according to an embodiment. FIG. 1 schematically illustrates the appearance of the cryopump 10, and FIG. 2 schematically illustrates the internal structure of the cryopump 10. The cryopump 10 is attached to, for example, a vacuum chamber 100 of an ion implanter, a sputtering device, a deposition device, or other vacuum processing devices, and is used in order to increase a degree of vacuum inside the vacuum chamber 100 to a level required for a desired vacuum process. For example, a high degree of vacuum of approximately $10^{-5}$ Pa to $10^{-8}$ Pa is realized in the vacuum chamber 100.

The cryopump 10 includes a compressor 12, a cryocooler 14, and a cryopump container 16. The cryopump container 16 includes a cryopump intake port 17. In addition, the cryopump 10 includes a rough valve 18, a body purge valve 20, an exhaust valve 22, and an exhaust purge valve 24, and the components are provided in the cryopump container 16.

The compressor 12 is configured to collect refrigerant gas from the cryocooler 14, to pressurize the collected refrigerant gas, and to supply the refrigerant gas to the cryocooler 14 again. The cryocooler 14 is also called an expander or a cold head, and configures a cryocooler together with the compressor 12. A thermodynamic cycle, through which chill is generated, is configured by performing circulation of the refrigerant gas between the compressor 12 and the cryocooler 14 with an appropriate combination of pressure fluctuations and volume fluctuations of the refrigerant gas in the cryocooler 14, and thereby the cryocooler 14 can provide cryogenic temperature cooling. Although the refrigerant gas is usually helium gas, other appropriate gases may be used. In order to facilitate understanding, a direction in which the refrigerant gas flows is indicated with an arrow in FIG. 1. Although the cryocooler is, for example, a two-stage Gifford-McMahon (GM) cryocooler, the cryocooler may be a pulse tube cryocooler, a Stirling cryocooler, or other types of cryocoolers.

As illustrated in FIG. 2, the cryocooler 14 includes a room temperature portion 26, a first cylinder 28, a first cooling stage 30, a second cylinder 32, and a second cooling stage 34. The cryocooler 14 is configured to cool the first cooling stage 30 to a first cooling temperature and to cool the second cooling stage 34 to a second cooling temperature. The second cooling temperature is lower than the first cooling temperature. For example, the first cooling stage 30 is cooled to approximately 65 K to 120 K, preferably 80 K to 100 K, and the second cooling stage 34 is cooled to approximately 10 K to 20 K. The first cooling stage 30 and the second cooling stage 34 are also called a high temperature cooling stage and a low temperature cooling stage, respectively. This way, by cooling each of the first cooling stage 30 and the second cooling stage 34 to the target cooling temperature, the cryopump 10 can be evacuated.

The first cylinder 28 connects the first cooling stage 30 to the room temperature portion 26, and thus, the first cooling stage 30 is structurally supported by the room temperature portion 26. The second cylinder 32 connects the second cooling stage 34 to the first cooling stage 30, and thus, the second cooling stage 34 is structurally supported by the first cooling stage 30. The first cylinder 28 and the second cylinder 32 extend coaxially along a radial direction. The room temperature portion 26, the first cylinder 28, the first cooling stage 30, the second cylinder 32, and the second cooling stage 34 are linearly arranged in a line in this order.

In a case where the cryocooler 14 is a two-stage GM cryocooler, a first displacer and a second displacer (not illustrated) are reciprocally arranged inside the first cylinder 28 and the second cylinder 32, respectively. A first regenerator and a second regenerator (not illustrated) are incorporated in the first displacer and the second displacer, respectively. In addition, the room temperature portion 26 includes a drive mechanism (not illustrated) such as a motor 26*a* for reciprocating the first displacer and the second displacer. The drive mechanism includes a flow path switching mechanism that switches between flow paths for working gas (for example, helium) to periodically repeat supply and exhaust of the working gas to and from the cryocooler 14.

In addition, the cryopump 10 includes a radiation shield 36 and a cryopanel 38. In order to provide a cryogenic surface for protecting the cryopanel 38 from radiant heat from the outside of the cryopump 10 or the cryopump container 16, the radiation shield 36 is thermally coupled to the first cooling stage 30, and is cooled to the first cooling temperature.

The radiation shield 36 has, for example, a tubular shape, and is disposed to surround the cryopanel 38 and the second cooling stage 34. An end portion of the radiation shield 36 on the cryopump intake port 17 side is opened, gas that enters through the cryopump intake port 17 from the outside of the cryopump 10 can be received in the radiation shield 36. An end portion of the radiation shield 36 on an opposite side to the cryopump intake port 17 may be closed, may have an opening, or may be opened. There is a gap between the radiation shield 36 and the cryopanel 38, and the radiation shield 36 is not in contact with the cryopanel 38. The radiation shield 36 is also not in contact with the cryopump container 16.

An inlet baffle 37 may be provided in the cryopump intake port 17 or between the cryopump intake port 17 and the cryopanel 38 to protect cryopanel 38 from radiant heat from a heat source outside the cryopump 10 (for example, a heat source in the vacuum chamber 100 to which the cryopump 10 is attached). The inlet baffle 37 may be fixed to an open end of the radiation shield 36 to be thermally coupled to the first cooling stage 30 of the cryocooler 14 through the radiation shield 36. Alternatively, the inlet baffle 37 may be attached to the first cooling stage 30. The inlet baffle 37 is cooled to the same temperature as the radiation shield 36, and can condense so-called type 1 gas (gas that condenses at a relatively high temperature, such as vapor) on a surface thereof.

In order to provide a cryogenic surface that condenses type 2 gas (for example, gas that condenses at a relatively low temperature, such as argon and nitrogen), the cryopanel 38 is thermally coupled to the second cooling stage 34, and is cooled to the second cooling temperature. In addition, in order to adsorb type 3 gas (for example, non-condensable gas, such as hydrogen), for example, activated carbon or another adsorbent is disposed on at least a part of a surface (for example, a surface on the opposite side to the cryopump intake port 17) of the cryopanel 38. Gas that enters the radiation shield 36 from the outside of the cryopump 10 through the cryopump intake port 17 is trapped through condensation or adsorption on the cryopanel 38. Since various known configurations can be adopted as appropriate as forms that can be taken, such as the disposition and shape of the radiation shield 36 or the cryopanel 38, description thereof will not be made in detail.

The cryopump container 16 includes a container body 16*a* and a cryocooler accommodating tube 16*b*. The cryopump container 16 is a vacuum chamber that is designed to maintain a vacuum during the evacuation operation of the cryopump 10 and to withstand a pressure in the ambient environment (for example, the atmospheric pressure). The container body 16*a* has a tubular shape where the cryopump intake port 17 is provided at one end and the other end is closed. The radiation shield 36 is accommodated in the container body 16*a*, and the cryopanel 38 is accommodated in the radiation shield 36 together with the second cooling stage 34 as described above. The cryocooler accommodating tube 16*b* has one end coupled to the container body 16*a* and the other end fixed to the room temperature portion 26 of the cryocooler 14. In the cryocooler accommodating tube 16*b*, the cryocooler 14 is inserted, and the first cylinder 28 is accommodated.

In the embodiment, the cryopump 10 is a so-called horizontal cryopump in which the cryocooler 14 is provided at a side portion of the container body 16*a*. A cryocooler insertion port is provided in the side portion of the container body 16*a*, and the cryocooler accommodating tube 16*b* is coupled to the side portion of the container body 16*a* at the cryocooler insertion port. Similarly, adjacent to the cryocooler insertion port of the container body 16*a*, a hole passing through the cryocooler 14 is also provided in a side portion of the radiation shield 36. The second cylinder 32 and the second cooling stage 34 of the cryocooler 14 are inserted into the radiation shield 36 through the holes, and the radiation shield 36 is thermally coupled to the first cooling stage 30 around the holes in the side portions.

The cryopump 10 can be provided in the vacuum chamber 100 at various postures at the site of use. For example, the cryopump 10 can be provided at a horizontal posture to be illustrated, that is, a posture in which the cryopump intake port 17 faces upward. In this case, a bottom portion of the container body 16*a* is positioned below the cryopump intake port 17, and the cryocooler 14 extends in a horizontal direction.

The cryopump 10 includes a first temperature sensor 40 for measuring the temperature of the first cooling stage 30 and a second temperature sensor 42 for measuring the temperature of the second cooling stage 34. The first temperature sensor 40 is attached to the first cooling stage 30. The second temperature sensor 42 is attached to the second cooling stage 34. The temperature of the first cooling stage 30 measured by the first temperature sensor 40 can be considered the temperature of the radiation shield 36, and the temperature of the second cooling stage 34 measured by the second temperature sensor 42 can be considered the temperature of the cryopanel 38. Accordingly, the first temperature sensor 40 can measure the temperature of the radiation shield 36 to output a first measured temperature signal indicating the measured temperature of the radiation shield 36. The second temperature sensor 42 can measure the temperature of the cryopanel 38 to output a second measured temperature signal indicating the measured temperature of the cryopanel 38. In addition, a pressure sensor 44 is provided inside the cryopump container 16. The pressure sensor 44 is provided in, for example, the cryocooler accommodating tube 16*b* and measure the internal pressure of the cryopump container 16 to output a measured pressure signal indicating the measured pressure.

In addition, the cryopump 10 includes a controller 46 that controls the cryopump 10. The controller 46 may be integrated with the cryopump 10, or may be configured as a control device separately from the cryopump 10.

The controller 46 may control the cryocooler 14 based on the cooling temperature of the radiation shield 36 and/or the cryopanel 38 in the evacuation operation of the cryopump 10. The controller 46 may be connected to the first temperature sensor 40 to receive the first measured temperature signal from the first temperature sensor 40, and may be connected to the second temperature sensor 42 to receive the second measured temperature signal from the second temperature sensor 42.

In addition, the controller 46 can operate as a regeneration controller of the cryopump 10. In addition, in a regeneration operation of the cryopump 10, the controller 46 may control the cryocooler 14, the rough valve 18, the body purge valve 20, the exhaust valve 22, and the exhaust purge valve 24 based on the internal pressure of the cryopump container 16 (or if necessary, based on the temperature of the cryopanel 38 and the internal pressure of the cryopump container 16). The controller 46 may be connected to the pressure sensor 44 to receive the measured pressure signal from the pressure sensor 44.

The internal configuration of the controller 46 is realized by an element or a circuit including a CPU and a memory of a computer as a hardware configuration and is realized by a computer program as a software configuration. However, in the drawing, the internal configuration is appropriately shown as functional blocks realized by cooperation of hardware and software. It is understood by those skilled in the art that the functional blocks can be realized in various forms by a combination of hardware and software.

For example, the controller 46 can be implemented by a combination of a processor (hardware) such as a central processing unit (CPU) or a microcomputer and a software program executed by the processor (hardware). The software program may be a computer program for causing the controller 46 to execute the regeneration of the cryopump 10.

The rough valve 18 is provided in the cryopump container 16, for example, the cryocooler accommodating tube 16*b*. The rough valve 18 is connected to a rough pump (not illustrated) provided outside the cryopump 10. The rough pump is a vacuum pump for evacuating the cryopump 10 to an operation start pressure thereof. The cryopump container 16 communicates with the rough pump when the rough valve 18 is opened by control of the controller 46. The cryopump container 16 is cut off from the rough pump when the rough valve 18 is closed. By opening the rough valve 18 and operating the rough pump, the cryopump 10 can be decompressed.

The body purge valve 20 enables "body purge" of supplying purge gas to the container body 16*a* of the cryopump container 16. As an exemplary configuration, the body purge valve 20 is provided in the cryopump container 16, for example, the container body 16*a*. In addition, the body purge valve 20 is connected to a purge gas source 48 or a purge gas supply device provided outside the cryopump 10.

Purge gas is supplied from the purge gas source 48 to the cryopump container 16 when the body purge valve 20 is opened by control of the controller 46. The purge gas supply to the cryopump container 16 is cut off when the body purge valve 20 is closed. By opening the body purge valve 20 and introducing purge gas into the cryopump container 16, the cryopump 10 can be pressurized. In addition, the temperature of the cryopump 10 can be increased from the cryogenic temperature to the room temperature or a temperature higher than the room temperature. Alternatively, as described below, while maintaining the pressure and the temperature in the cryopump 10 or suppressing a significant increase thereof by allowing the body purge valve 20 to adjust the flow rate of purge gas, purge gas can be supplied to the cryopump 10.

The purge gas may be, for example, nitrogen gas or other dry gas. The temperature of the purge gas may be adjusted to, for example, the room temperature (higher than 0° C., for example, 15° C. to 30° C.) or may be heated to a temperature (for example, 50° C. or lower or 80° C. or lower) higher than the room temperature. Alternatively, the temperature of the purge gas may be cooled to a temperature (for example, a temperature lower than 0° C.) lower than the room temperature. As described below, when purge gas is supplied to the cryopump container 16 in the middle of a cooling operation of the cryocooler 14, the cooling of the purge gas is suitable for suppressing an increase in the temperature of the cryopanel 38.

The exhaust valve 22 is provided in the cryopump container 16, for example, the cryocooler accommodating tube 16*b*. The exhaust valve 22 is provided as an outlet of the cryopump container 16 to exhaust fluid from the inside to the outside of the cryopump 10. The exhaust valve 22 may also be an inlet to an exhaust line 50 described below. The fluid is exhausted from the cryopump container 16 when the exhaust valve 22 is opened by control of the controller 46. The fluid exhaust from the cryopump container 16 is cut off when the exhaust valve 22 is closed. The fluid to be exhausted from the exhaust valve 22 is basically a gas but may be liquid or a mixture of gas and liquid. The exhaust valve 22 may be, for example, a normally closed control valve.

Further, the exhaust valve 22 may function as a vent valve or a safety valve or may be configured to be mechanically opened when a predetermined differential pressure works. In this case, the exhaust valve 22 is mechanically opened without requiring control when the internal pressure of the cryopump is high for some reason. Accordingly, the high internal pressure can be released to the exhaust line 50.

The exhaust purge valve 24 enables "exhaust purge" of supplying purge gas to the exhaust line 50. As an exemplary configuration, the exhaust valve 22 and the exhaust purge valve 24 may be separately provided, and the exhaust purge valve 24 may be connected to the downstream of the exhaust valve 22 through a pipe. Alternatively, the exhaust purge valve 24 may be integrated with the exhaust valve 22 such that purge gas is supplied to the exhaust valve 22 or the downstream of the exhaust valve 22. The exhaust purge valve 24 may be provided in the cryopump container 16, for example, the cryocooler accommodating tube 16*b*. The exhaust purge valve 24 is connected to the purge gas source 48 or another purge gas source.

Purge gas is supplied from the purge gas source 48 to the exhaust line 50 when the exhaust purge valve 24 is opened by control of the controller 46. The purge gas supply to the exhaust line 50 is cut off when the exhaust purge valve 24 is closed. As the purge gas to be supplied from the exhaust purge valve 24, the same gas (for example, nitrogen gas) as the purge gas to be supplied from the body purge valve 20 is used, but different suitable gas may be used.

The exhaust line 50 is provided to exhaust the exhaust fluid from the cryopump 10 to a processing device 60, in which an upstream end thereof is connected to the exhaust valve 22 and the exhaust purge valve 24 and a downstream end thereof is connected to the processing device 60.

The processing device 60 may be, for example, an abatement device that processes hazardous gas (for example, hydrogen gas or another gas having explosiveness; or for example, fluorine-based gas or another gas such as halogen-based gas having corrosiveness or toxicity) in the exhaust fluid to produce harmless gas, or may be a processing device that processes hazardous gas to reduce hazardous properties. As the processing device 60, a well-known abatement device or processing device can be appropriately adopted. Therefore, the details will not be described.

Gas is accumulated in the cryopump 10 by continuing the evacuation operation of the cryopump 10. In order to exhaust the accumulated gas to the outside, the regeneration of the cryopump 10 is performed. The regeneration of the cryopump 10 generally includes a temperature increase process, an exhaust process, and a cool-down process.

A gate valve 102 is provided between the cryopump 10 and the vacuum chamber 100 to be evacuated, and when the regeneration of the cryopump 10 starts, the gate valve 102 is closed and the cryopump 10 is separated from the vacuum chamber 100 (the internal volume of the cryopump 10 is isolated from the vacuum chamber 100).

The temperature increase process includes: increasing the temperature of the cryopump 10 to a boiling point of hazardous gas in the gas trapped in the cryopump 10, or a temperature exceeding the boiling point; and further increasing the temperature of the cryopump 10 to a regeneration temperature of the cryopump 10. Typically, the hazardous gas is, for example, type 2 gas or type 3 gas, and the boiling point of the hazardous gas is, for example, 100 K or lower. The regeneration temperature is, for example, the room temperature or a temperature higher than the room temperature. Accordingly, in most cases, the hazardous gas is revaporized in the first half of the temperature increase process, in particular, immediately after the start of the temperature increase process, is exhausted from the cryopump 10, and flows into the processing device 60. The hazardous gas is removed from the cryopump 10 in the temperature increase process.

A heat source for increasing the temperature is, for example, the cryocooler 14. The cryocooler 14 enables a temperature increase operation (so-called reverse temperature increase). That is, the cryocooler 14 is configured such that adiabatic compression occurs in working gas when the drive mechanism provided in the room temperature portion 26 operates in a direction opposite to the cooling operation (that is, the motor 26*a* rotates reversely). With compression heat obtained in this manner, the cryocooler 14 heats the first cooling stage 30 and the second cooling stage 34. The radiation shield 36 and the cryopanel 38 are heated with the first cooling stage 30 and the second cooling stage 34 as heat sources, respectively. In addition, purge gas supplied from the body purge valve 20 into the cryopump container 16 can also contribute to an increase in the temperature of the cryopump 10. Alternatively, a heating device such as an electric heater may be provided in the cryopump 10. For example, an electric heater that can be controlled independently of the operation of the cryocooler 14 may be mounted on the first cooling stage 30 and/or the second cooling stage 34 of the cryocooler 14.

In the exhaust process, gas trapped in the cryopump 10 is revaporized or liquefied, and is exhausted as gas, liquid, or a mixture of gas and liquid through the exhaust line 50 or through the rough valve 18. Type 2 gas and type 3 gas can be already easily exhausted from the cryopump 10 in the temperature increase process. Therefore, the exhaust process is a process for exhausting mainly type 1 gas. Once the exhaust process is completed, the cool-down process is started. In the cool-down process, the cryopump 10 is cooled again to a cryogenic temperature for the evacuation operation. Once the regeneration is completed, the gate valve 102 is opened again, and the cryopump 10 can start the evacuation operation.

Incidentally, one of main uses of the cryopump 10 is to evacuate an ion implanter. In this case, mainly hydrogen gas is accumulated in the cryopump 10. The hydrogen gas trapped in the cryopanel 38 can be revaporized at a stroke during the regeneration, in particular, immediately after the start of the regeneration (temperature increase process). In an existing regeneration method, the hydrogen gas is diluted by the body purge in the cryopump container 16. Nevertheless, the exhaust fluid flowing from the cryopump container 16 to the processing device 60 through the exhaust line 50 may temporarily contain a considerably high concentration of hydrogen gas.

The high concentration of hydrogen gas has a risk of explosion or combustion. Therefore, for the safety management of the cryopump 10 and the exhaust line 50, it is desirable to suppress a concentration peak of the hydrogen gas in the exhaust fluid to be as low as possible. It is desirable to suppress the concentration peak of the hydrogen gas to be lower than 4%, for example, in consideration of an explosion limit. Alternatively, in consideration of safety factor, it is desirable to suppress the concentration peak of the hydrogen gas to be a lower value, for example, lower than 2%. In order to dilute the inside of the cryopump container 16 up to a low concentration by the body purge, a considerably high flow rate (for example, several hundreds of liters per minute) of purge gas may be required immediately after the regeneration start. Even for another type of hazardous gas, in order to suppress the concentration peak immediately after the regeneration start, a high flow rate of purge gas may be temporarily required. However, this countermeasure may be unrealistic in consideration of a required cost increase.

Figure 3:
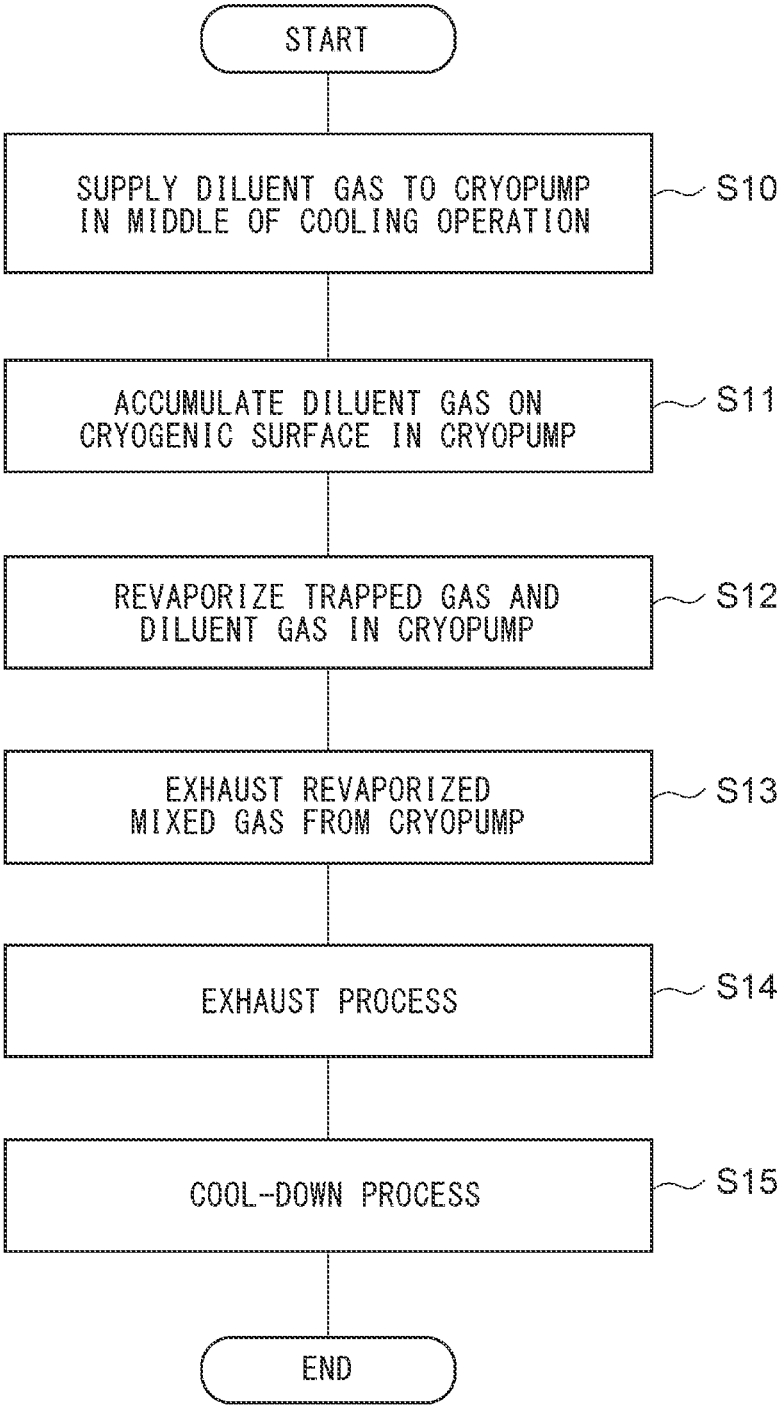
FIG. 3 is a flowchart illustrating an exemplary cryopump regeneration method according to an embodiment.

FIG. 3 is a flowchart illustrating an exemplary cryopump regeneration method according to an embodiment. The cryopump regeneration method includes: supplying diluent gas to the cryopump 10 (S10); accumulating the diluent gas on a cryogenic surface in the cryopump 10 in the middle of the cooling operation (S11); revaporizing another gas trapped on the cryogenic surface together with the diluent gas (S12); and exhausting mixed gas of the revaporized gas and the diluent gas from the cryopump 10 (S13). The revaporization of the gas (S12) and the exhaust of the mixed gas (S13) may be included in the temperature increase process. This method may further include the exhaust process (S14) and the cool-down process (S15) described below.

As a result, the diluent gas can be previously accumulated on the cryogenic surface in the cryopump 10. Therefore, even when hazardous gas is stored in the cryopump 10, not only the hazardous gas but also the diluent gas are revaporized in the regeneration. The hazardous gas can be diluted in the cryopump 10, and the concentration of the hazardous gas exhausted from the cryopump 10 during the regeneration of the cryopump 10 can be suppressed. As a result, the safety of the regeneration of the cryopump 10 can be improved.

The diluent gas may be purge gas. The cryogenic surface is a surface that is cooled to a temperature at which the diluent gas is condensed, and may be, for example, a surface of the cryopanel 38 or the second cooling stage 34. Alternatively, as long as the cryogenic surface is a surface that is cooled to a temperature at which the diluent gas is condensed, the cryogenic surface may be another surface in the cryopump 10, for example, a surface of the radiation shield 36, the inlet baffle 37, or the cryocooler 14 (for example, the first cooling stage 30 or the second cylinder 32). The other gas trapped on the cryogenic surface may include hazardous gas (for example, hydrogen gas).

In exemplary implementation of the regeneration method illustrated in FIG. 3 to the cryopump 10, the body purge is performed under cooling of the cryopump 10, that is, in the middle of the cooling operation of the cryocooler 14. As a result, purge gas can be condensed on the cryogenic surface such as the cryopanel 38 and can be stored in the cryopump 10. This way, a large amount of purge gas can be previously introduced into the cryopump 10 before the temperature increase process in the regeneration of the cryopump 10, and can be temporarily stored in the cryopump container 16 in a solid or liquid state. In the temperature increase process, a large amount of purge gas is also revaporized together with another gas such as hazardous gas trapped on the cryopanel 38 by the evacuation operation of the cryopump 10.

Accordingly, as compared to an existing regeneration method where the previous introduction of the purge gas is not performed, the regeneration method according to the embodiment can reduce the concentration of the hazardous gas in the cryopump 10. As a result, the concentration of the hazardous gas in the gas exhausted from the cryopump 10 and flowing from the exhaust line 50 can also be reduced.

Accordingly, the controller 46 may be configured to control the body purge valve 20 such that purge gas is supplied to the cryopump container 16 in the middle of a cooling operation of the cryocooler 14 where the cryopanel 38 is cooled. The controller 46 may be configured to identify an operation state of the cryocooler 14 and, for example, may be configured to receive or generate a cryocooler state signal indicating the operation state of the cryocooler 14. The cryocooler state signal may indicate the current state of the cryocooler 14 among a plurality of states including the cooling operation, the stop, and the reverse temperature increase operation of the cryocooler 14. Alternatively, the controller 46 may receive the measured temperature by the first temperature sensor 40 and/or the second temperature sensor 42, and may determine whether or not the cryocooler 14 performs the cooling operation based on the measured temperature. The controller 46 may be configured to open the body purge valve 20 based on the cryocooler state signal or the measured temperature when cryocooler 14 performs the cooling operation.

In general, the body purge valve 20 may be configured to achieve a relatively high flow rate of purge gas desired for the temperature increase process and the exhaust process of the regeneration. The purge gas has a temperature around the room temperature as described above and is considerably higher than that of the cryopanel 38 under cooling. Therefore, although the cryocooler 14 performs the cooling operation, the temperature of the cryopanel 38 can be increased by the body purge. An excessive temperature increase may disturb the condensation of the purge gas on the cryopanel 38.

Accordingly, the controller 46 may be further configured to control the body purge valve 20 such that purge gas is supplied to the cryopump container 16 even after completion of the cooling operation of the cryocooler 14 (that is, in the temperature increase process and/or the exhaust process), and a flow rate of purge gas supplied in the middle of the cooling operation may be lower than a flow rate of purge gas supplied after the completion of the cooling operation. As a result, desirably, the flow rate of purge gas in the previous purge gas introduction for the dilution according to the embodiment can be suppressed as compared to the typical body purge (that is, the temperature increase process and/or the exhaust process). As a result, input heat to the cryopump 10 caused by the previous purge gas introduction can be suppressed.

In the exemplary cryopump 10, from the viewpoint of reducing the cost, the body purge valve 20 may be an on/off valve, and the flow rate of purge gas of the body purge valve 20 may be fixed. In this case, in order to suppress the flow rate of the purge gas, the controller 46 may be configured to control the body purge valve 20 such that purge gas is intermittently supplied to the cryopump container 16 in the middle of the cooling operation of the cryocooler 14.

In addition, the controller 46 may be configured to control the cryocooler 14 such that, when purge gas is supplied, a cooling capacity of the cryocooler 14 is increased to be higher than a cooling capacity before the supply of the purge gas. As an exemplary configuration of the cryocooler 14 that can adjust the cooling capacity, the motor 26*a* that drives the cryocooler 14 may be configured such that an operation frequency is variable, and an inverter that controls the operation frequency of the motor 26*a* may be provided. In this case, the controller 46 may control the inverter such that, when purge gas is supplied, the operation frequency of the motor 26*a* is increased to be higher than that before the supply of the purge gas. As a result, when purge gas is supplied, the cooling capacity of the cryocooler 14 can be increased. Thus, an increase in the temperature of the cryopump 10 caused by the previous purge gas introduction can be suppressed.

Figure 4:
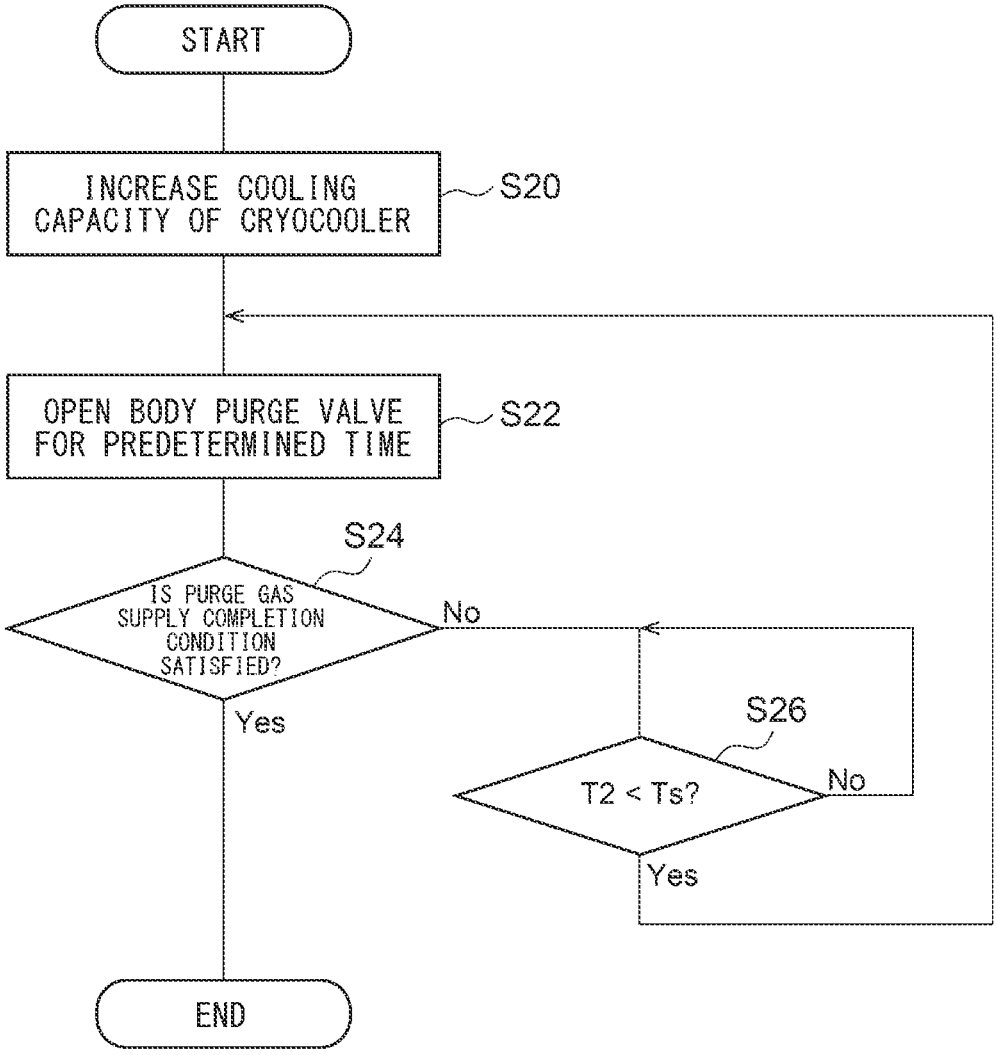
FIG. 4 is a flowchart illustrating an example of the cryopump regeneration method illustrated in FIG. 3.

FIG. 4 is a flowchart illustrating an example of the cryopump regeneration method illustrated in FIG. 3. The previous purge gas introduction process illustrated in FIG. 4 may be executed by the controller 46 in response to a regeneration start instruction. The regeneration start instruction may be input to the controller 46 from a user of the cryopump 10, or may be input to the controller 46 from a host controller such as a control device for a vacuum processing device on which the cryopump 10 is mounted.

As illustrated in FIG. 4, when the present process starts, first, the cooling capacity of the cryocooler 14 is increased (S20). For example, the controller 46 may control the motor 26*a* such that the operation frequency of the motor 26*a* that drives the cryocooler 14 is increased. In general, before the regeneration start of the cryopump 10, the cryocooler 14 operates at a relatively low operation frequency (for example, lower than 50 Hz or 60 Hz). As a result, the temperature of the cryopanel 38 that is cooled to the cryogenic temperature can be stably maintained. Accordingly, the controller 46 may increase the operation frequency of the motor 26*a* up to an operation frequency exceeding the relatively low operation frequency. The operation frequency of the motor 26*a* may be increased to, for example, an operation frequency higher than 50 Hz or 60 Hz or to a maximum operation frequency that can be adopted by the motor 26*a*. The maximum operation frequency of the motor 26*a* may be in a range of, for example, 70 Hz to 100 Hz.

The body purge valve 20 is opened for a predetermined time (S22). The controller 46 controls the body purge valve 20 such that the body purge valve 20 is opened, the opened state is continued for the predetermined time, and the body purge valve 20 is closed when the predetermined time elapses.

The predetermined time for which the body purge valve 20 is opened may be preset such that the amount of purge gas supplied to the cryopump container 16 through the body purge valve 20 for the predetermined time is, for example, less than about 1 liter, less than about 0.5 liters, or less than about 0.2 liters under a normal condition (for example, 0° C. and 1 atm). The predetermined time for which the body purge valve 20 is opened can be realized by being selected in a range of, for example, 0.1 seconds to 2 seconds (or, for example, 0.5 seconds to 1 second). This predetermined time may be previously acquired based on empirical knowledge of a designer of the cryopump 10 or an experiment, a simulation, or the like of the designer, and may be previously stored in the controller 46. As a result, it is expected that an increase in the temperature of the cryopanel 38 caused by the purge gas supplied to the cryopump container 16 through the body purge valve 20 can be reduced sufficiently in practice.

Next, the controller 46 determines whether or not a predetermined supply completion condition of purge gas is satisfied (S24). The supply completion condition is set based on the amount of purge gas required to dilute a maximum amount of hazardous gas (for example, hydrogen gas) in the specification that can be accumulated in the cryopump 10 to a desired low concentration. For example, the supply completion condition may be completion of the number of times or the time where the body purge valve 20 is opened to supply the required amount of purge gas. For example, assuming that the body purge valve 20 is required to be opened 10 times for the predetermined time in order to supply the required amount of purge gas, the supply completion condition is satisfied when the body purge valve 20 is opened 10 times. Alternatively, assuming that the body purge valve 20 is required to be opened for 10 seconds in total as the predetermined time in order to supply the required amount of purge gas, the supply completion condition is satisfied when the body purge valve 20 is opened for 10 seconds in total. This supply completion condition may be previously acquired based on empirical knowledge of a designer of the cryopump 10 or an experiment, a simulation, or the like of the designer, and may be previously stored in the controller 46.

When the supply completion condition is not satisfied (No in S24), the controller 46 acquires a measured temperature T2 of the cryopanel 38 by the second temperature sensor 42, and compares the measured temperature T2 to a temperature threshold Ts of the cryogenic temperature (S26). In order to check whether or not the temperature of the cryopanel 38 is sufficiently lower to condense purge gas, the temperature threshold Ts is preset from a temperature range lower than a boiling point of the purge gas, for example, 10 K to 30 K (or, for example, 10 K to 20 K), and is previously stored in the controller 46.

The controller 46 is configured to control the body purge valve 20 such that purge gas is supplied when the measured temperature T2 falls below the temperature threshold Ts of the cryogenic temperature. That is, when the measured temperature T2 is the temperature threshold Ts or higher (No, S26), the controller 46 waits for a predetermined time, acquires the measured temperature T2 again, and compares the measured temperature T2 to the temperature threshold Ts (S26). On the other hand, when the measured temperature T2 is lower than the temperature threshold Ts (Yes, S26), the controller 46 opens the body purge valve 20 again (S22).

This way, after confirming that the measured temperature T2 of the cryopanel 38 is lower than the temperature threshold Ts, the controller 46 opens the body purge valve 20 such that purge gas can be supplied to the cryopump container 16. When the measured temperature T2 of the cryopanel 38 is higher than the temperature threshold Ts, the controller 46 closes the body purge valve 20 and waits until the measured temperature T2 falls below the temperature threshold Ts.

Next, the controller 46 determines whether or not the supply completion condition of purge gas is satisfied (S24). When the supply completion condition is not satisfied (No in S24), the temperature measurement and comparison and the intermittent supply of purge gas are performed as described above again. On the other hand, when the supply completion condition is satisfied (Yes in S24), the present process is completed. In this case, the cooling operation of the cryocooler 14 is stopped, and the temperature increase process (S12 and S13 in FIG. 3), the exhaust process (S14), and the cool-down process (S15) are performed.

In the above-described embodiment, the example where the body purge valve 20 is an on/off valve that supplies purge gas at a fixed constant flow rate has been described. However, in one embodiment, the body purge valve 20 may be a flow rate variable valve that can adjust the flow rate of purge gas. In this case, the controller 46 may be configured to control the body purge valve 20 such that purge gas is continuously supplied to the cryopump container 16 in the middle of the cooling operation of the cryocooler 14. The controller 46 may control the body purge valve 20 such that the flow rate of purge gas continuously supplied in the middle of the cooling operation is lower than the flow rate of purge gas supplied after the completion of the cooling operation (that is, the temperature increase process and/or the exhaust process).

The flow rate of purge gas continuously supplied in the middle of the cooling operation may be, for example, lower than ½ or lower than 1/10 the flow rate of purge gas supplied after the completion of the cooling operation. The flow rate of purge gas continuously supplied in the middle of the cooling operation may be, for example, less than about 3 liters per minute, less than about 2 liters per minute, or less than about 1 liter per minute under a normal condition (for example, 0° C. and 1 atm). As a result, it is expected that an increase in the temperature of the cryopanel 38 caused by the purge gas supplied to the cryopump container 16 through the body purge valve 20 can be reduced sufficiently in practice.

Even when the purge gas is continuously supplied to the cryopump container 16, as in S26 of FIG. 4, the measured temperature T2 of the cryopanel 38 may be monitored. That is the controller 46 may acquire the measured temperature T2 of the cryopanel 38 by the second temperature sensor 42, and may compare the measured temperature T2 to the temperature threshold Ts of the cryogenic temperature. The controller 46 controls the body purge valve 20 such that purge gas is supplied when the measured temperature T2 falls below the temperature threshold Ts of the cryogenic temperature. On the other hand, when the measured temperature T2 is the temperature threshold Ts or higher, the controller 46 controls the body purge valve 20 such that the supply of the purge gas is interrupted. This way, after confirming that the measured temperature T2 of the cryopanel 38 is lower than the temperature threshold Ts, the controller 46 opens the body purge valve 20 such that purge gas can be supplied to the cryopump container 16. When the measured temperature T2 of the cryopanel 38 is higher than the temperature threshold Ts, the controller 46 closes the body purge valve 20 and waits until the measured temperature T2 falls below the temperature threshold Ts.

The purge gas source 48 has a function of adjusting the flow rate of purge gas, and thus may adjust the flow rate of body purge supplied to the cryopump container 16. In this case, instead of adjusting the flow rate of the body purge using the body purge valve 20, the controller 46 may control the purge gas source 48 to obtain a desired flow rate of purge gas.

Figure 5:
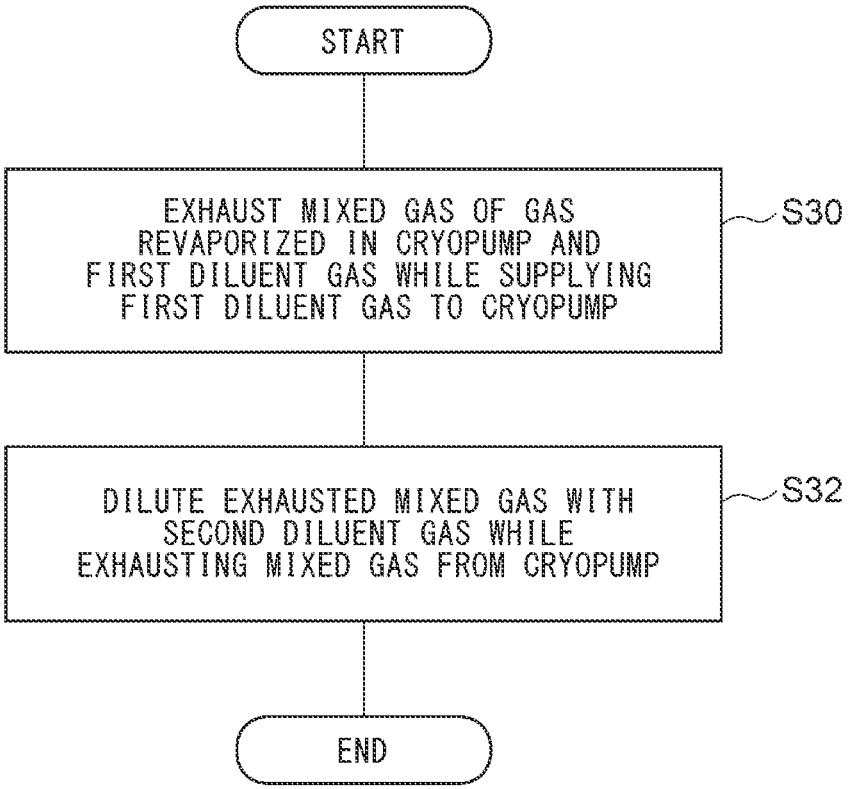
FIG. 5 is a flowchart illustrating an exemplary cryopump regeneration method according to an embodiment.

FIG. 5 is a flowchart illustrating an exemplary cryopump regeneration method according to an embodiment. The cryopump regeneration method includes: exhausting mixed gas of gas revaporized in the cryopump 10 and first diluent gas from the cryopump 10 while supplying the first diluent gas to the cryopump 10 (S30); and diluting the exhausted mixed gas with second diluent gas while exhausting the mixed gas from the cryopump 10 (S32). Both of the steps (S30 and S32) are performed in spatially different locations (the body purge valve 20 and the cryopump container 16 in S30 and the exhaust valve 22 in S32) but are performed temporally at the same time.

As a result, even when hazardous gas is stored in the cryopump 10, first, the hazardous gas is diluted with the first diluent gas in the cryopump 10. Concurrently, the mixed gas of the hazardous gas of the first diluent gas exhausted from the cryopump 10 is diluted with the second diluent gas. Through the two stages of dilution, the concentration of the hazardous gas exhausted from the cryopump 10 during the regeneration of the cryopump 10 can be suppressed.

The dilution exhaust process (S30 and S32) illustrated in FIG. 5 is performed at an initial stage of the regeneration. The dilution exhaust process (S30 and S32) may be performed after the completion of the cooling operation of the cryocooler 14, that is, for example, in the temperature increase process (S12 and S13 in FIG. 3). Accordingly, the dilution exhaust process (S30 and S32) may be performed together with the above-described previous purge gas introduction process (that is, after the previous purge gas introduction process). After the dilution exhaust process, the exhaust process (S14 in FIG. 3) and the cool-down process (S15) may be performed.

The first diluent gas may be purge gas supplied from the body purge valve 20 to the cryopump container 16, and the second diluent gas may be purge gas supplied from the exhaust purge valve 24 to the exhaust line 50.

In an exemplary operation of the body purge valve 20, the body purge valve 20 may be continuously opened while the exhaust valve 22 is closed. The reason for this is that, when the exhaust valve 22 is closed, exhaust from the cryopump container 16 to the exhaust line 50 is not performed. The body purge valve 20 may be repeatedly opened and closed while the exhaust valve 22 is opened. A ratio of the opening time in an opening and closing cycle of the body purge valve 20 may be constant. Alternatively, the ratio of the opening time in the opening and closing cycle of the body purge valve 20 may change over time. For example, the concentration of hazardous gas in the cryopump container 16 decreases over time due to exhaust. Therefore, the ratio of the opening time in the opening and closing cycle of the body purge valve 20 may increase over time, and finally the body purge valve 20 may be continuously opened.

The present invention has been described above based on the examples. It will be understood by those skilled in the art that the present invention is not limited to the above-described embodiment, and that various modifications are possible, and such modifications are also within the scope of the present invention. Various features described in relation to the certain embodiment are also applicable to other embodiments. A new embodiment resulting from combination has the effects of each of the combined embodiments.

In the above-described embodiment, the diluent gas (for example, the first diluent gas) is supplied from the body purge valve 20 to the cryopump container 16. However, in one embodiment, another diluent gas source may be adopted. For example, the diluent gas may be supplied from the vacuum chamber 100 of the vacuum processing device where the cryopump 10 is provided to the cryopump container 16 through the gate valve 102 and the cryopump intake port 17. Typically, the vacuum processing device includes a gas source that supplies, for example, argon gas or another inert gas to the vacuum chamber 100. Therefore, this gas may be used as the diluent gas.

Although the present invention has been described using specific terms based on the embodiment, the embodiment only shows one aspect of the principle and application of the invention, and the embodiment allows for many modifications and changes in arrangement without departing from the concept of the invention as defined in the claims.

It should be understood that the invention is not limited to the above-described embodiment, but may be modified into various forms on the basis of the spirit of the invention. Additionally, the modifications are included in the scope of the invention.

What is claimed is:

1. A cryopump comprising:

a cryopump container;

a cryopanel disposed in the cryopump container;

a cryocooler provided in the cryopump container and thermally coupled to the cryopanel, the cryocooler configured to perform a cooling operation to cool the cryopanel to a cryogenic temperature at which purge gas is condensed on the cryopanel;

a body purge valve configured to supply the purge gas to the cryopump container; and a regeneration controller configured to control the body purge valve such that the purge gas is supplied to the cryopump container and condensed on the cryopanel in a middle of the cooling operation of the cryocooler where the cryopanel is cooled.

2. The cryopump according to claim 1, wherein the regeneration controller is configured to control the body purge valve such that the purge gas is intermittently supplied to the cryopump container in the middle of the cooling operation of the cryocooler.

3. The cryopump according to claim 1, wherein the regeneration controller is further configured to control the body purge valve such that the purge gas is supplied to the cryopump container even after completion of the cooling operation of the cryocooler, and a flow rate of the purge gas supplied in the middle of the cooling operation is lower than a flow rate of the purge gas supplied after the completion of the cooling operation.

4. The cryopump according to claim 1, wherein the regeneration controller is configured to control the cryocooler such that, when the purge gas is supplied, a cooling capacity of the cryocooler is increased to be higher than a cooling capacity of the cryocooler before the supply of the purge gas.

5. The cryopump according to claim 1, further comprising a temperature sensor configured to measure a temperature of the cryopanel, wherein the regeneration controller is configured to:

acquire a measured temperature of the cryopanel by the temperature sensor;

compare the measured temperature to a temperature threshold of a cryogenic temperature, and control the body purge valve such that the purge gas is supplied when the measured temperature falls below the temperature threshold of the cryogenic temperature.

6. A cryopump regeneration method comprising:

performing a cooling operation of a cryocooler of a cryopump to cool a cryogenic surface in the cryopump to a cryogenic temperature at which diluent gas is condensed on the cryogenic surface;

supplying the diluent gas to the cryopump in a middle of the cooling operation of the cryocooler of the cryopump;

accumulating the diluent gas on the cryogenic surface in the cryopump;

revaporizing another gas trapped on the cryogenic surface together with the diluent gas; and exhausting mixed gas of the revaporized gas and the diluent gas from the cryopump.

7. The cryopump according to claim 1, wherein the regeneration controller is configured to perform a regeneration of the cryopump comprising a temperature increase process to heat the cryocooler, wherein the regeneration controller is configured to perform the cooling operation of the cryocooler before the temperature increase process in the regeneration of the cryopump.

8. The cryopump according to claim 1, further comprising an exhaust valve provided in the cryopump container, the exhaust valve being closed in the cooling operation of the cryocooler.

* * * * *